US011401678B1

(12) United States Patent
Schwartz

(10) Patent No.: US 11,401,678 B1
(45) Date of Patent: Aug. 2, 2022

(54) FLOOD PROTECTION SYSTEM

(71) Applicant: David Joel Schwartz, Houston, TX (US)

(72) Inventor: David Joel Schwartz, Houston, TX (US)

( * ) Notice: Subject to any disclaimer, the term of this patent is extended or adjusted under 35 U.S.C. 154(b) by 52 days.

(21) Appl. No.: 16/984,022

(22) Filed: Aug. 3, 2020

Related U.S. Application Data

(60) Provisional application No. 62/882,475, filed on Aug. 3, 2019.

(51) Int. Cl.
*E04H 9/14* (2006.01)
*E02D 27/34* (2006.01)

(52) U.S. Cl.
CPC ..... *E02D 27/34* (2013.01); *E04H 9/14* (2013.01)

(58) Field of Classification Search
CPC ..... E02D 27/34; E02D 31/00; E04H 9/14; E04H 9/145; E06B 2009/007; E06B 9/00; Y02A 50/00; Y02A 10/30; E04B 1/66
See application file for complete search history.

(56) References Cited

U.S. PATENT DOCUMENTS

| | | | | |
|---|---|---|---|---|
| 4,375,929 | A | 3/1983 | Clark | |
| 4,488,386 | A * | 12/1984 | Thompson | E04G 21/24 52/169.1 |
| 6,425,213 | B1 | 7/2002 | Lachapelle | |
| 7,364,385 | B1 | 4/2008 | Luke | |
| 7,849,645 | B2 | 12/2010 | Pamboris | |
| 2004/0045243 | A1 * | 3/2004 | Lockwood | E04H 9/145 52/408 |
| 2004/0098937 | A1 * | 5/2004 | Blake | E04H 9/145 52/302.6 |
| 2008/0008533 | A1 | 1/2008 | Rehn | |
| 2013/0302092 | A1 * | 11/2013 | Ortiz | E02B 7/005 405/36 |
| 2014/0366455 | A1 * | 12/2014 | Helton | E06B 5/10 49/483.1 |
| 2018/0058088 | A1 * | 3/2018 | Clohessy | E04H 9/145 |
| 2020/0123800 | A1 | 4/2020 | Blyme | |
| 2020/0240138 | A1 * | 7/2020 | Ouimette | E04H 9/145 |

FOREIGN PATENT DOCUMENTS

| | | | | |
|---|---|---|---|---|
| EP | 2990565 | A2 | 3/2016 | |
| FR | 2531475 | A | 2/1984 | |
| FR | 2531475 | A1 * | 2/1984 | E04H 9/145 |
| GB | 2379948 | A | 3/2003 | |
| GB | 2397086 | A | 7/2004 | |

OTHER PUBLICATIONS https://www.lsuagcenter.com/topics/family_home/home/design_construction/design/remodeling%20renovation/preventing%20flood%20damage/flood-wraps-and-temporary-shields.
https://www.midwestwaterproofing.com/waterproofing/waterproofing-membrane/.

* cited by examiner

*Primary Examiner* — Carib A Oquendo
(74) *Attorney, Agent, or Firm* — Phillip Free Law, PLLC

(57) ABSTRACT

An improved flood protection system for a home or other building. The flood protection system includes a waterproof membrane that is positioned on the exterior of the building. The membrane has first and second horizontal edges. A sealant is applied to the foundation between the first horizontal edge of the membrane and the foundation of the building. A termination bar mechanically attaches to the foundation, pressing the first horizontal edge of the membrane and the sealant toward the foundation to create a watertight seal.

19 Claims, 7 Drawing Sheets

FLOOD PROTECTION SYSTEM

CROSS-REFERENCE TO RELATED APPLICATION

This application claims the benefit of U.S. provisional application No. 62/882,475 entitled "Flood Protection System," filed Aug. 3, 2019, the contents of which are incorporated herein by reference.

FIELD OF THE INVENTION

The present invention relates generally to systems for protecting homes and other buildings from damage caused by flood water.

BACKGROUND OF THE INVENTION

The frequency of flooding of residential and commercial buildings is increasing around the world, mainly as a result of climate change. Intrusion of even a few inches of floodwater for only a few minutes can cause extensive damage to these structures. While many flood protection systems exist to protect larger properties from flood water, such as self-rising walls and temporary fencing, these systems are very expensive, intrusive to install, may violate local flood plain regulations, and/or require extensive manpower for installation just prior to an anticipated flood, making them impractical for protection of an individual home.

Several flood protection systems applicable to individual homes have been described previously (See US20040098937, U.S. Pat. No. 7,364,385, US20180058088, U.S. Pat. No. 4,488,386, FR2531475). However, all have significant weaknesses. These include the need for extensive excavation, which greatly increases the installation cost, impacts land use around the home (landscaping, sidewalks, etc.), and may also require utility line relocation. Many of these systems rely on the use of a buried concrete storage trench/box for storage and anchoring of a waterproof liner, based on the sometimes-incorrect assumption that floodwater cannot permeate through the soil underneath the trench/box. Anchoring the lower edge of the waterproof liner in concrete also makes it difficult to monitor and repair any issues that can arise in this critical seal area over time. Many of the previously disclosed systems do not have drainage systems to capture and remove the inevitable leakage and rainwater that falls on the "dry" side of the barrier. Additionally, most of the systems do not describe methods to adequately address "irregularities" that are found on the outside of a typical home—e.g., pipes exiting the walls, AC lines, gutter downspouts, fencing that abuts the home, etc.

U.S. Pat. No. 4,488,386 describes a flood protection system in which a waterproof membrane is attached to the footing of the home's foundation around its entire circumference, using tar as an adhesive. The liner is stored in an underground box. Just prior to a flood, the homeowner removes the membrane from its storage container, and hangs it on hooks that are preinstalled on the home's walls around the entire home. This system requires extensive excavation to install, does not contain a drainage system, is prone to leakage at the lower sealed edge of the membrane over time, and does not include methods to effectively deal with commonly encountered items such as piping exiting the home's walls, doors, and protrusions such as windows extending outward from the walls of the home. The novel system of the present invention, while similar in some respects, describes new methods and materials that overcome these weaknesses.

DESCRIPTION OF THE PREFERRED EMBODIMENT

Figure 1:
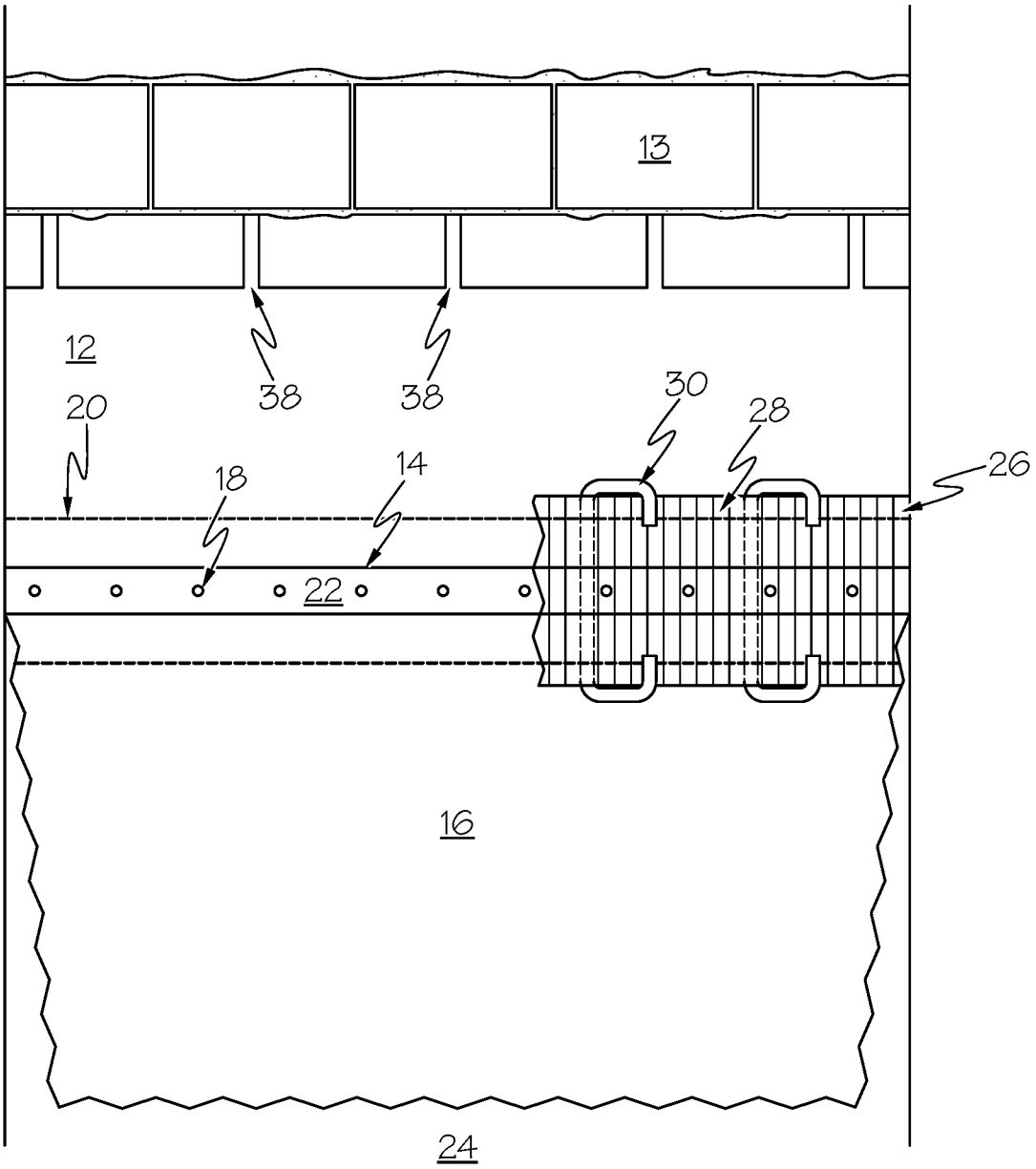
FIG. 1 is a front elevation view of a portion of a typical residential house incorporating an embodiment of a flood protection system constructed in accordance with the present invention.

Referring to the drawings, FIG. 1 shows one embodiment of the flood protection system 10 installed on an exemplary home 11 having a concrete slab foundation 12 and a wall 13 (shown here with an external, brick facade). A first edge 14 of a continuous waterproofing membrane 16, preferably comprised of ethylene propylene diene terpolymer synthetic rubber ("EPDM"), is mechanically attached to the foundation 12 using concrete fasteners 18, sealant 20, and a metal termination bar 22. The first edge 14 is preferably oriented such that the membrane 16 extends downward from the termination bar 22. During deployment of the system 10 prior to a flooding event, a second edge 24 of the membrane 16 will be lifted and attached to the wall 13. Thus, the membrane 16 is installed in a manner such that it exits the termination bar 22 going downward. This orientation allows for easy visibility of the seal between the membrane 16 and foundation 12 as the membrane 16 is installed, and it also allows for improved access later for seal integrity checks and any necessary repairs. This is a novel, beneficial feature that is not present in previous residential flood protection systems.

Figure 1A:
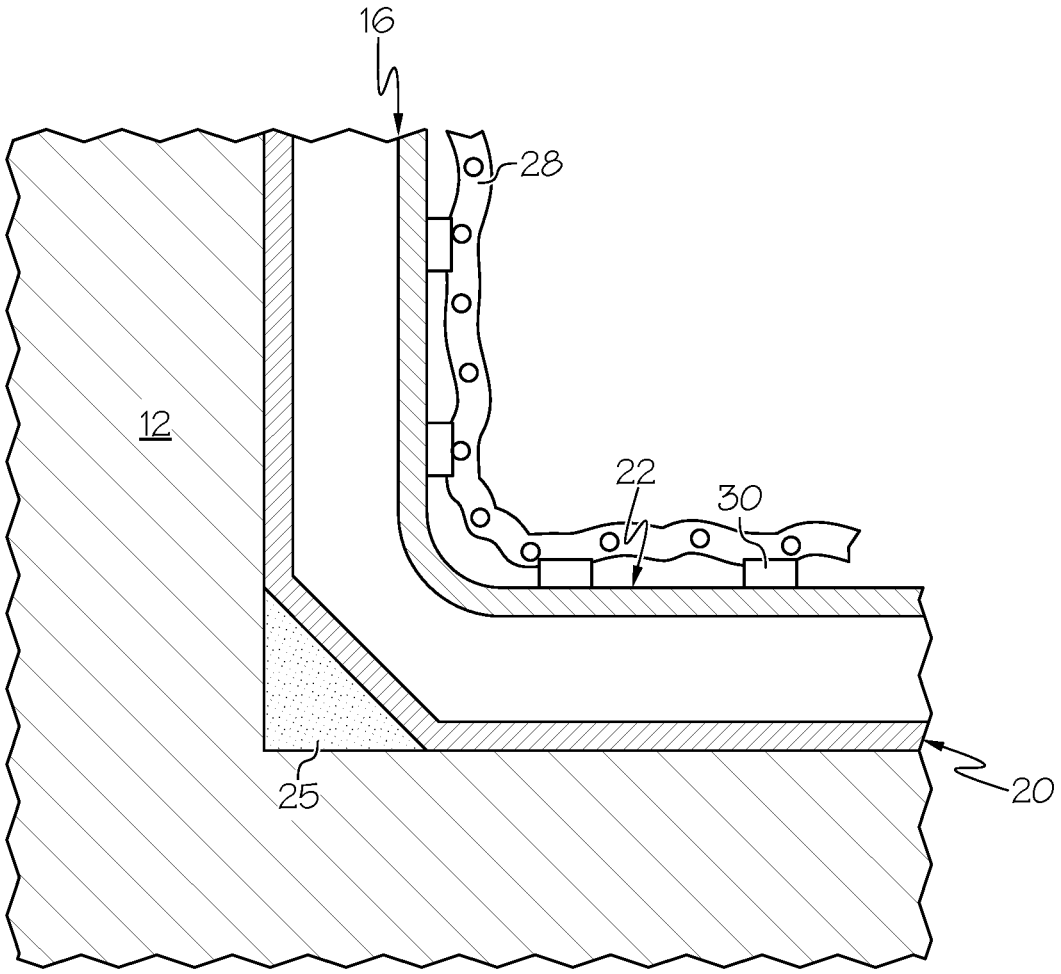
FIG. 1A is an overhead view of an installation for inside corners.

In preferred embodiments, the concrete foundation 12 is repaired prior to installation of the membrane 16, if needed. For best results, it is preferable that the foundation 12 be free of sharp edges, cracks, roughness, dirt, corrosion, and other imperfections to ensure a reliable, stable, watertight seal between the membrane 16 and foundation 12. To this end, any of these imperfections found on the foundation 12 at or near the point where the membrane 16 will be installed are repaired using standard techniques (e.g., grinding, parging, rebar replacement, etc.) prior to membrane 16 installation. In addition, all outside corners of the foundation 12 are rounded using an angle grinder, to ensure the continuity of the seal across these areas. For a similar reason, a bead of filler material 25 (as shown in FIG. 1A) is applied at all inside corners, so that the angle the membrane 16 is required to traverse is more gradual. A variety of filler material 25 can be used for this purpose. Examples of suitable filler material 25 include concrete, silicone, polyurethane, and double-sided butyl sealant tape. Persons skilled in the art will recognize other types of filler material 25 that can be used for this purpose, and all are within the scope of the present invention.

Following preparation of the concrete foundation 12, the sealant 20, preferably double-sided butyl tape, is applied along the foundation 12 by first applying a liquid adhesive to the foundation 12 in a three-inch strip, followed by applying the butyl tape sealant 20, and then rolling the butyl tape sealant 20 with a two-inch silicone seam roller (not shown) to ensure a continuous seal. The membrane 16 is then unrolled on the ground along the wall 13. The factory seamed edge is used as the first edge 14 of the membrane 16 that is sealed to the foundation 12, if possible, as this gives a perfectly straight edge to work with during installation. The top three inches of the first edge 14 of the membrane 16 is cleaned using EPDM membrane cleaner, followed by EPDM tape primer, and then this edge of the membrane 16 is carefully pressed against the butyl tape sealant 20, being careful to keep the membrane 16 completely flat on the tape sealant 20, keeping the first edge 14 of the membrane 16 about one inch above the top of the tape sealant 20, and creating as little stress as possible at the junction between the membrane 16 and the tape sealant 20. The membrane/tape junction is then rolled using the silicone seam roller. A termination bar 22, preferably made from one-inch aluminum or other suitable metal or plastic, is fastened in place directly over the center of the tape sealant 20 using fasteners 18 about every 12 inches (additional fasteners 18 are preferably added later in the process as part of the drainage system).

The use of a termination bar 22 to ensure continuous compression of the seal between the membrane 16 and the foundation 12 provides more stability and greater resistance to deterioration over time as compared to the purely adhesive seal used in prior art techniques.

As previously noted, the preferred material for membrane 16 is EPDM roofing membrane. EPDM membrane has very good flexibility and puncture/tear resistance, and a 45-mil thickness has been found to offer a good balance between membrane strength and weight. The membrane 16 should be light enough for a typical homeowner to deploy prior to a flood, but tough enough to withstand the stress that floodwaters and floating debris might place on it. The preferred fasteners 18 are stainless steel concrete drive pins, the preferred sealant 20 is one-eighth-inch×two-inch double-sided self-adhesive butyl rubber sealant tape, and the preferred termination bar 22 is a one-inch×one-eighth-inch aluminum bar with pre-drilled holes every 6 inches. These specific materials have been found to give a reliable, leak-proof seal of the membrane 16 to the home's foundation 12. While these are the most preferred materials, those skilled in the art will recognize other suitable materials, all of which are within the scope of the present invention. Highly preferred embodiments of the present invention include a drainage system 26 that includes a drain, such as a dimpled sheet drain 28, which in FIG. 1 is shown being held in place directly in front of the termination bar 22 by aluminum clips 30 that are installed using the fasteners 18. Including the fasteners 18 used for installation of the termination bar 22, the fasteners 18 are spaced every six inches on the termination bar 22, with the clips 30 for the sheet drain 28 being fastened using every other fastener (i.e., 12 inches between each clip 30). The sheet drain 28 is attached directly in front of the termination bar 22 to ensure quick and easy drainage of any water that might leak past the membrane seal at the top of the termination bar 22.

The sheet drain 28 is positioned flat against the foundation 12, with the dimples pointed towards the foundation 12, as this orientation will result in less stress on the membrane 16 once floodwater begins pressing the membrane 16 and sheet drain 28 against the foundation 12. The sheet drain 28 can be easily bent around corners, so as to follow the natural contours of the foundation 12. An alternative approach is to glue the sheet drain 28 directly to the membrane 16 with the dimples pointing away from the membrane 16, just below the termination bar 22. When the membrane 16 is raised in preparation for a flood, the sheet drain 16 will end up just in front of the termination bar 22. This approach eliminates the need for the drain clips 30, which may be beneficial with regard to system storage and aesthetics.

Figure 2:
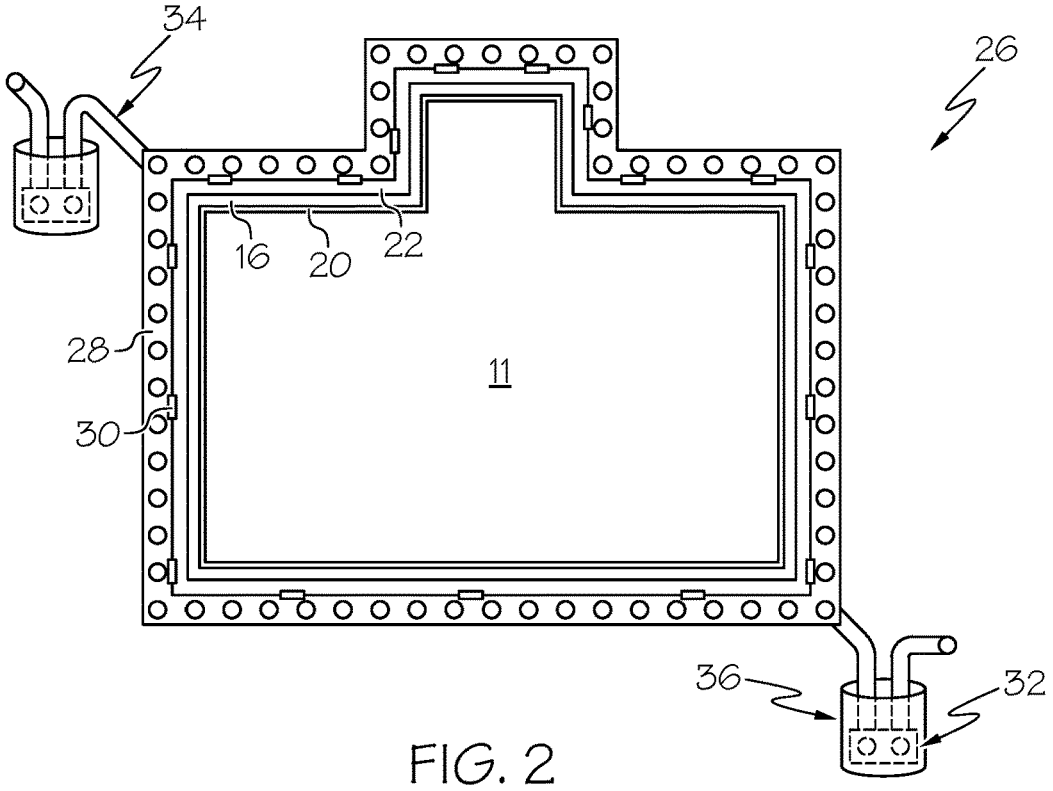
FIG. 2 is an overhead view of a typical home demonstrating placement of the drainage system in a preferred embodiment.

FIG. 2 shows an overhead view of a prototypical home 11. A drain, which in this embodiment is a sheet drain 28, and membrane 16 encircle the entire circumference of the home 11, fastened to the foundation 12 with the termination bar 22, as described above. Although the present embodiment shows sheet drain 28 as the preferred drain, persons skilled in the art will recognize numerous other drains that will be suitable consistent with the present invention, such as without limitation a perforated pipe or system of gravel or other porous material. Any leakage through the membrane/termination bar seal from the wet side to the dry side can easily flow through the sheet drain 28 to one or more sump pumps 32 that are part of the drainage system 26. Standard fittings and techniques are used to transition the sheet drain 28 to standard diameter drainpipe 34, exit the membrane 16, and enter the basin 36 for the sump pump 32 in a watertight manner. Being watertight, the sump basin 36 can be installed on the "wet" side of the membrane 16. Since the sheet drain 28 is relatively level around the entire house, it is most preferred to bury the sump basin 36 so that any water collected in the drainage system 26 will have a natural tendency to flow to the sump basin(s) 36 for quick removal. Depending on the footprint size of the home 11 and other installation details, more than one sump pump 32 may be required. The purpose of drainage system 26 is to remove any water that builds up above ground level. Thus, the sump pump(s) 32 do not necessarily need to be buried.

The membrane 16 can be installed at almost any height on the foundation 12. However, the most preferred location is 3-5 inches below the top of the foundation 12. This location ensures the sheet drain 28 is below the weep holes 38 of the home 11, so any leakage can be routed to the sump pump 32 before water has a chance to enter the home 11 via the weep holes 38. This location also helps minimize any necessary excavation for system installation, as it is generally recommended that the top 4-6 inches of a home's foundation 12 remain exposed above ground level. This location also helps with storage system installation, as it leaves several inches of foundation 12 to work with both above and below the termination bar 22.

The rate of water permeation through the concrete foundation 12 is slow relative to the typical length of time floodwaters remain around a home 11, and so this route of possible water intrusion can be assumed to be negligible. Even if the floodwater remains present for a relatively long period of time, the amount of water that would enter the home 11 via permeation through the foundation 12 would be much lower than the amount of floodwater that would enter the home 11 if the flood protection system 10 was not present, and so the resulting damage would be much less. This assumes no cracks exist in the foundation 12 that travel completely through the foundation 12 from the outside to the inside, which can and should be repaired if found during installation of the system 10.

A variety of approaches can be taken to allow the homeowner to hang the membrane 16 on the exterior walls 13, when a flood event is anticipated. The simplest is to use hardware, such as hooks 42 in the embodiment shown in FIG. 3, installed on the walls 13 at 2-3 foot intervals at the desired flood protection height, and grommets 42 installed on the second edge 24 of the membrane 16. Other types of hardware are suitable for hanging the membrane 16 on the wall, and any such hardware can be used in accordance with the present invention.

There are many other possible approaches, with some providing improved wind and rain resistance, aesthetics, etc. During system installation, gutter downspout clips (not shown) are detached from the downspout and house wall and reattached above the flood protection height. This allows for the membrane 16 to be deployed behind the downspouts, which is advantageous for minimizing rainwater buildup on the dry side of the membrane 16, which could overwhelm the drainage system 26.

While not explained in detail above, the system 10 disclosed may optionally have "self-rising" or mechanical assist features. In such embodiments, the second edge of the membrane includes or is attached to a material of lower density than that of water. The storage container is designed to allow the lid of the container to open appropriately, allowing the membrane 16 to float as the floodwater rises. Such an embodiment of the invention would be "self-rising," with no advance effort needed by the homeowner. The deployment of the membrane 16 could also be mechanically assisted with installation of the appropriate equipment, if desired.

Figure 3:
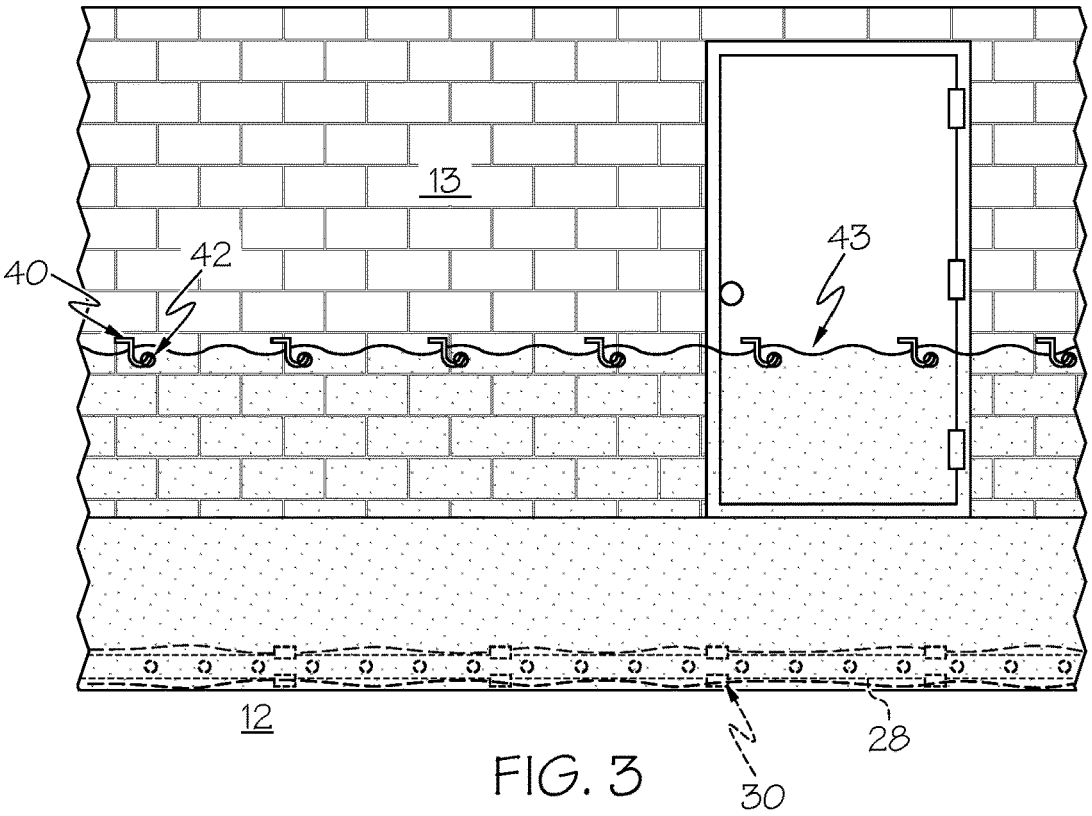
FIG. 3 is an elevation view of a wall of the home showing the deployment of the membrane in one embodiment.

Standard doors and low windows do not have sufficient strength to withstand floodwater hydrostatic pressure. Thus, some embodiments of the protection system 10 include placing panels 43 of sufficient strength in front of these areas, as shown in FIG. 3. Plastic honeycomb panels have been found to be a suitable option for the panels 43, as they are strong, lightweight, stable to the elements, and relatively inexpensive. The panels 43 must be wide enough that each end is supported by the framing on each side of the door or window being protected. The hardware for keeping the panels 43 in place can vary, as long as the panels 43 are held immobile directly in front of the opening as the floodwaters rise. During deployment, the second edge 24 of the membrane 16 can be hooked to hardware 40 at the top edge of the panel 43, as it traverses the walls 13, as shown in FIG. 3. For wider doors, such as French doors or garage doors, removable posts can be installed to provide intermediate support points for the panels 43. Alternatively, commercial floodproof door and window panels are available.

It is critical that the system 10 be installed in a manner that will minimize any stress placed on the membrane 16 as floodwaters rise and press the membrane 16 against the home's walls 13. This includes any sharp edges on the home 11 or protection system 10. To this end, the edges of the drain clips 30 that hold the sheet drain 28 should be rounded as shown in FIG. 1. In addition, installing the sheet drain 28 directly in front of the termination bar 22 helps protect the membrane 16 from any potential sharp edges that may be present on the fasteners 18 for the termination bar 22.

Ideally the hydrostatic pressure of the floodwater is borne completely by the walls 13 of the home 11, which for standard residential construction have been shown to be stable to up to three feet of water pressure. To ensure this, protrusions or indentations in the home's walls 13 relative to the foundation need to be treated differently than a standard straight wall 13. An example is the stress that would be placed on the membrane 16 if it is forced to conform around a hose reel that is attached to the wall 13 below the protection height, if no excess membrane 16 is present to take this into account. To minimize stress on the membrane 16 during flood conditions, specific installation techniques have been developed for certain features that are commonly encountered on the bottom three feet of a typical home's walls 13. These include items such as corners, pipes exiting the walls 13, hose valves and reels, and windows that extend out from the wall façade.

For hose valves and other small protrusions, the protrusion can be treated as a "rough spot" in the wall 13, and an extra layer of membrane 16, or patch, can be glued to the appropriate spot on the main membrane 16, to act as a reinforcing patch in this particular higher stress spot.

Figure 4A:
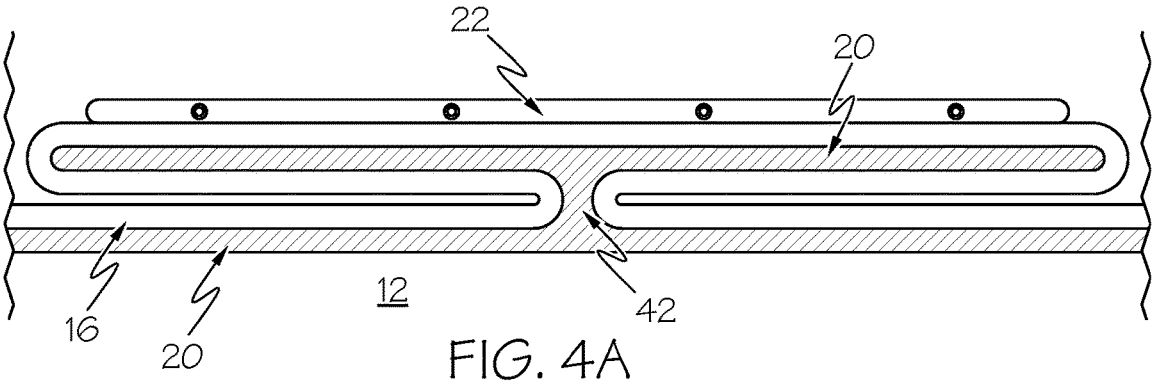
FIG. 4A is an overhead view of a preferred installation method for items that extend beyond the walls of the home.

If the protrusion extends outward from the wall 13 more than 2-3 inches, treatment as described below is preferred versus a patch, to minimize excess stress on the membrane 16 during flood conditions. FIG. 4A shows an overhead view of a preferred installation method for items that extend beyond the home's walls 13, such as hose reels and windows, where excess membrane 16 is needed near the second edge 24 of the membrane 16, but a clean and straight watertight connection to the home's foundation 12 is desired at the first edge 14. The first edge 14 of the membrane 16 is folded over on itself in a symmetrical manner to form a box pleat, or sandwich type structure, with tape sealant 20 used in the middle of the "sandwich" configuration, in addition to the standard tape sealant 20 along the foundation 12. A bit of extra butyl tape sealant 20 is also used in the center of the sandwich (indicated at 42), to ensure there are no gaps in the compression seal that would allow water to enter the system 10.

This sandwich structure allows for a reliable watertight seal at the first edge 14 of the membrane 16, while giving additional membrane 16 directly above this point. The extra membrane 16 allows for sufficient membrane 16 to go around protrusions such as hose reels or protruding windows. The width of the sandwich will depend on the distance the protrusion sticks out from the wall 13—for a protrusion that sticks out X inches from the wall 13, the full sandwich width will be ½×, to minimize the stress on the membrane 16 during flood conditions. This "sandwich" technique avoids the need to create one or more seams in the membrane 16, which can result in an increased possibility of leakage.

Figure 4B:
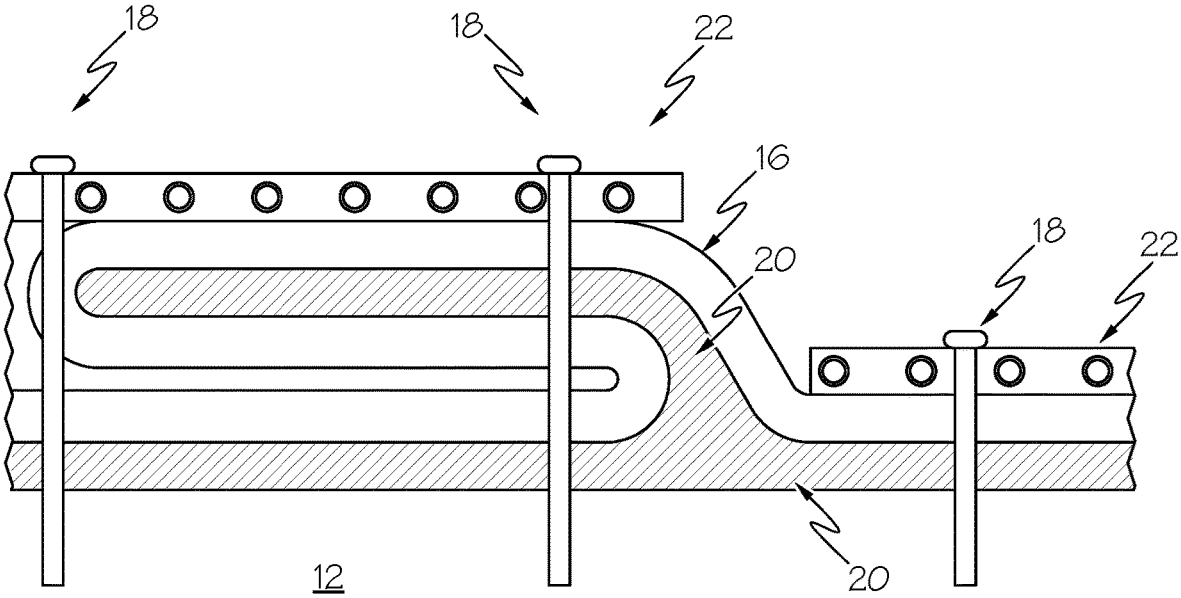
FIG. 4B is an overhead view of an alternative installation method for items that extend beyond the walls of the home.

Closely related to the "full sandwich" configuration described above, a "half sandwich" configuration, shown in FIG. 4B from overhead, can also be used, which is essentially a knife pleat. The half sandwich approach is a bit easier to use in cases where the full sandwich structure would be less than 3-4 inches wide. The half sandwich configuration can also be used when the first edge 14 of the membrane 16 starts to get slightly off-level versus the tape sealant tape 20. A half sandwich can be used to reorient the first edge 14 of the membrane 16 back along the desired path.

As shown in FIG. 4B, it is preferred to use a separate termination bar 22 to mechanically hold the sandwich portion of the membrane 16 to the home foundation (for both half and full sandwich structures), as the sandwich section is thicker than the adjacent (single layer of) membrane 16 on either side of the sandwich. Use of a continuous termination bar 22 across this entire section could result in a void between the termination bar 22 and the membrane 16 at the thickness change at each edge of the sandwich, resulting in poor mechanical pressure/sealing at these locations. Use of slightly longer fasteners 18 for fastening the termination bar 22 to the thicker sandwich structures, as shown in FIG. 3B, is also recommended.

Figure 4C:
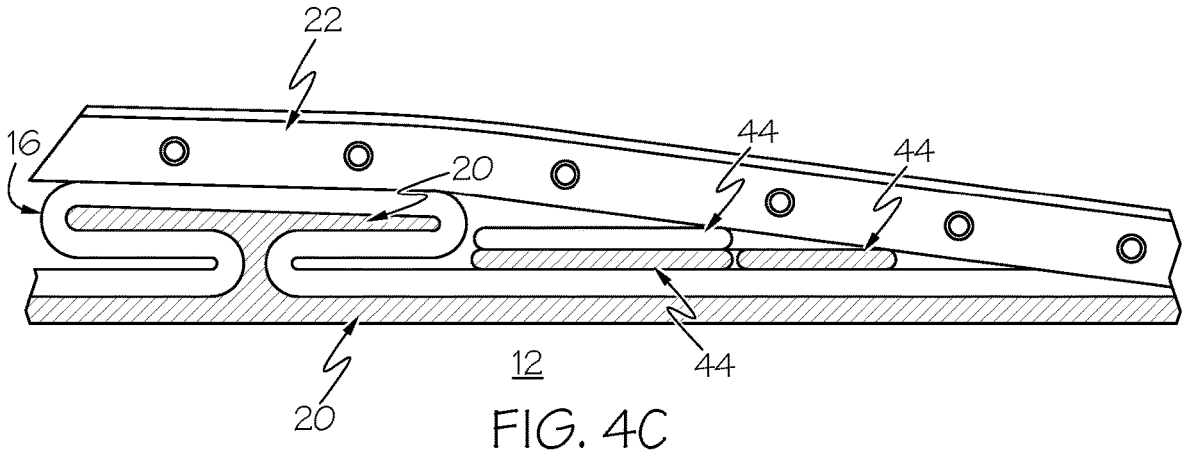
FIG. 4C is an overhead view of an alternative installation method for items that extend beyond the walls of the home.

In lieu of using a separate termination bar 22 for the sandwich, additional layer(s) of membrane (numbered 44 in FIG. 4C, viewed from overhead) can be used on each end of the sandwich, in a "step down" fashion, to more gradually change the thickness of the tape/membrane as it traverses this section. This enables a single termination bar 22 to maintain consistent compression on the membrane/tape against the foundation 12 through this section.

It has been found that this approach of adding one or more layers of membrane 44 is also useful in other areas during membrane 16 installation, where the termination bar 22 does not lay completely flat against the membrane 16. In all cases, the additional layers 44 must be permanently adhered to the main membrane 16, using techniques and materials commonly found in the rubber roofing industry.

Figure 5:
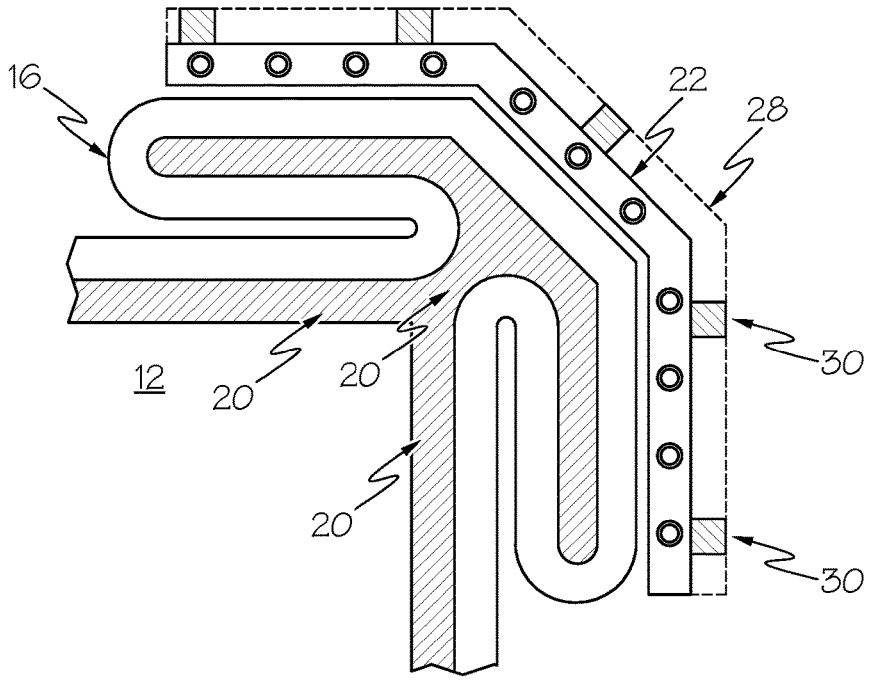
FIG. 5 is an overhead view of an installation method to deal with exterior corners of the home.

When the membrane 16 is installed around outside corners, it has been found to be advantageous to leave some excess slack in the membrane 16, to help make deployment of the membrane 16 a bit easier. This also helps make installation of the sheet drain 28 around these corners easier. The same "sandwich" concept described above can be used to achieve this goal. As shown in FIG. 5, the membrane 16 is symmetrically installed around the corner in a "sandwich" manner, using tape sealant 20 and a separate termination bar 22 to ensure water tightness. This approach eliminates the need to introduce an additional seam in the membrane 16 as is done in prior art approaches.

Where piping exits a home's walls within the bottom 3 feet of the wall 13 but above the foundation 12 (which is typically the case), various approaches can be taken depending on circumstances. For pipes that exit the home 11 and then turn upward within 1-2 feet of the wall 13, the pipe can be treated as a protrusion, as described above—in other words, a sandwich technique can be used during installation so the membrane 16 can easily traverse around the vertical pipe when deployed.

If the pipe exits the wall 13 and goes directly to an AC unit, standard rubber membrane roofing techniques and materials can be used to give a watertight fit around the pipe, namely field-formed flashing, a pre-formed pipe boot, or a vertical pitch pan filled with sealant. While proven and effective, these are not the most preferred approaches, as they require that the membrane 16 be immobilized around the pipe so as to not disturb the membrane/pipe seal. This means the membrane 16 needs to remain in place permanently and cannot be stored and protected out of sight.

Figure 6:
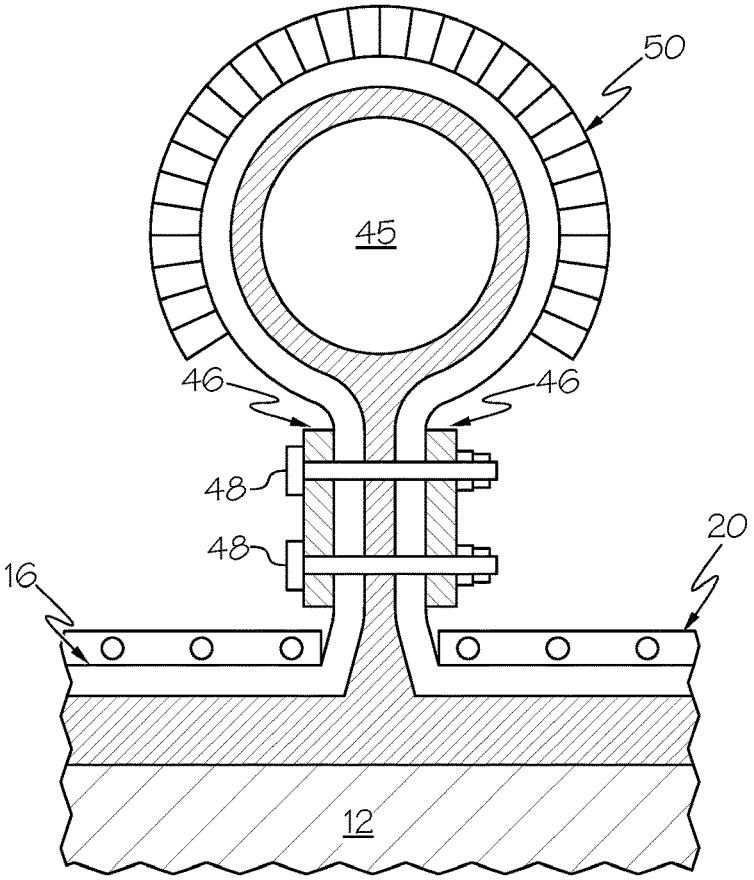
FIG. 6 is an overhead view of an installation method to deal with items that extend beyond the walls of the home.

The more preferred method for handling such situations is to use a modified version of the sandwich approach described above, shown in FIG. 6. The membrane 16 is routed off the foundation 12, around the pipe 45, and back onto the foundation 12. A continuous bead of butyl tape sealant 20 is used along this path. To ensure consistent mechanical pressure on the membrane 16 while it travels off the home's foundation 12 and around the pipe 45, two metal plates 46 are attached through the membrane/tape/membrane "bridge" section using bolts, nuts and washers 48; and a pipe clip of the appropriate size 50 is used to tightly hold the membrane 16 to the pipe 45. Additionally, the use of extra butyl tape sealant 20, where the membrane 16 leaves the foundation 12 and pipe 45, is recommended. An alternative approach is to pour a new, small concrete pad (not shown) that encompasses the pipe 45 and is attached to the home's foundation 12, and then route the membrane 16 from the foundation 12 onto the pad and then back onto the foundation 12, as it traverses this section. In essence, this extends the home's foundation 12 to include the pipe 45.

Attaching the first edge 14 of the membrane 16 directly to the foundation 12 of the home 11 obviates the need for an attachment point external to the home's foundation 12, as many other residential flood protection systems require, as well as eliminates the possibility of floodwater permeation under such a point through the soil. This also helps minimize the system's impact on the land around the home 11—i.e., on landscaping, driveways, sidewalks, fencing, etc. Even if underground system storage is desired for aesthetic reasons, the storage container for the current system 10 can be relatively small and lightweight—standard 4-6 inch gutters have been found to work well.

A variety of approaches can be used to store and protect the system 10, when not deployed. The most preferred approach is shown as a side view in FIG. 7. A roughly 12-inch wide strip of protective material, such as protection strip 52, is glued to the bottom, outside face of the membrane 16, beginning just where it exits on the lower edge of the termination bar 22. The protection strip can be constructed from the same type of EPDM membrane as used for the rest of the system 10, or another other suitable material. Whichever material is used, it needs to have the appropriate physical properties to protect the system 10 from the anticipated conditions (weathering, weed eaters, etc.) over the long term. The most preferred material is either EPDM cover tape or EPDM membrane.

Figure 7:
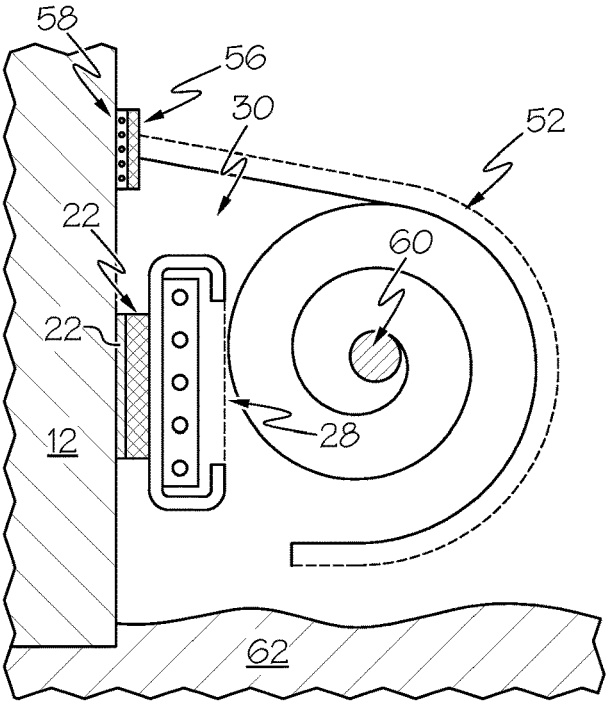
FIG. 7 is an embodiment of a storage system.

The top 2-3 inches of the protection strip 52 are not glued to the EPDM membrane, but rather allowed to hang off the membrane 16 as show in FIG. 7. A first strip of hook and loop fastener 56, is glued to the uppermost edge of the protection strip 52, and the mating strip of the hook and look fastener 58 is glued directly to the home's foundation 12, just above the top of the drain clips 30. To store the flood protection system 10, the membrane 16 is laid on the ground on top of the protection strip 52, and then the two strips of hook and loop fastener 56, 58 are joined together along the circumference of the foundation 12. This storage approach is more simple, quicker, and less intrusive than other possible approaches.

An alternative is to only glue the first 2-3 inches of the protection strip 52 to the lower edge of the membrane 16 and let the remaining 9-10 inches of the protection strip 52 hang off the membrane 16. This approach makes replacement of the protection strip 52 easier if it is damaged, and also minimizes the impact of the protection strip 52 on the weight of membrane 16 the homeowner needs to lift to deploy the system 10.

Optionally, a pole 60 can be adhered to the second edge 24 of the membrane 16, to allow the homeowner to roll the membrane 16 down for storage, which can help minimize the storage space needed to store the membrane 16.

The system 10 may also include a storage system. Since the distance between the membrane/termination bar seal and the ground can vary, the storage system will need to be able to handle this variable. The strength of the adherence of the protection strip 52 to the membrane 16 and of the hook and loop fasteners 56, 58, for the system described above, are both sufficient to fully support the entire weight of the membrane 16. In other words, this most preferred storage approach will work whether the system 10 is above grade, at grade, or even below grade (i.e., if soil is placed against the storage cover after installation is complete).

Another potential approach for system storage is to leave about 12 inches of the first edge 14 of the membrane 16 sticking out above the termination bar 22 when the membrane 16 is installed. After installation, this extra membrane 16 can then be folded over the system's main membrane 16 and tucked underneath the membrane 16 and used as a storage cover in this fashion.

Figure 8:
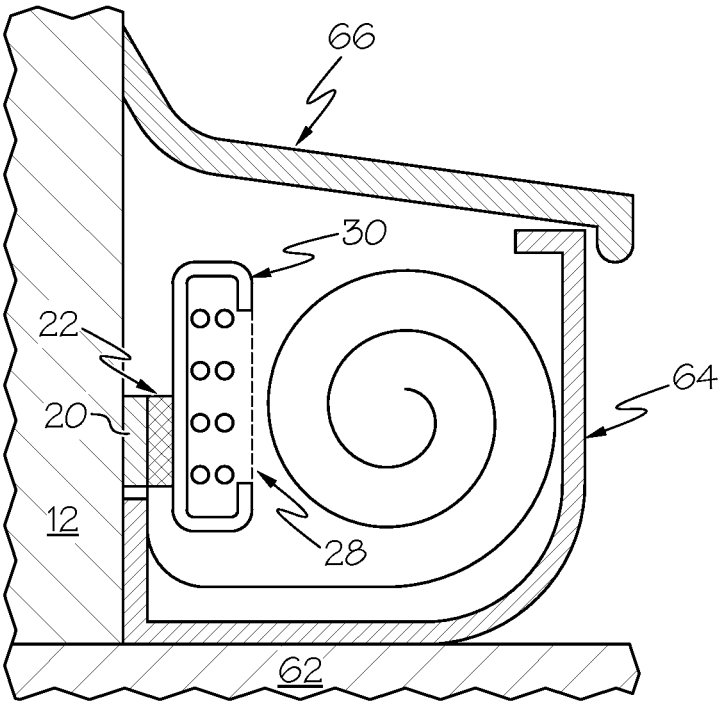
FIG. 8 is an alternative embodiment of a storage system.

Another storage option that can be used is a long, narrow trough 64, as shown in FIG. 8, made of a material that is stable to the anticipated conditions, such as plastic, fiberglass, wood or metal. The trough 64 can be buried, or it can be lain on the ground 62 at the base of the home's walls 13. Because the trough 64 does not act as the system's wet/dry transition point, as in other systems, it does not need to be very heavy, large or strong. It has been found that standard aluminum or vinyl roof guttering can be used. The trough 64 needs a lid 66 to protect the other components of the system 10 as well. The lid 66 can rest against the home's foundation 12, just above the drain clips 30 (the highest part of the protection system 10 when not deployed).

The lid 66 can be hinged where it meets the outer edge of the trough 64, or it can have an overhanging lip as shown in the FIG. 8. The top of the lid 66 can also clip behind the top of the drain clip 30, to hold its edge against the home's foundation 12 in a watertight manner. The lid 66 can be made of a variety of materials, including metal, plastic, and wood. Holes (not shown) can be drilled in the bottom of the trough 64 to ensure any water that enters can drain out. It is most desirable for the lid 66 to make a watertight connection with the home foundation 12, so water cannot enter the system 10 at this point. If this occurs, it will remain trapped in the membrane 16 and could result in mold, smells, etc.

Figure 9:
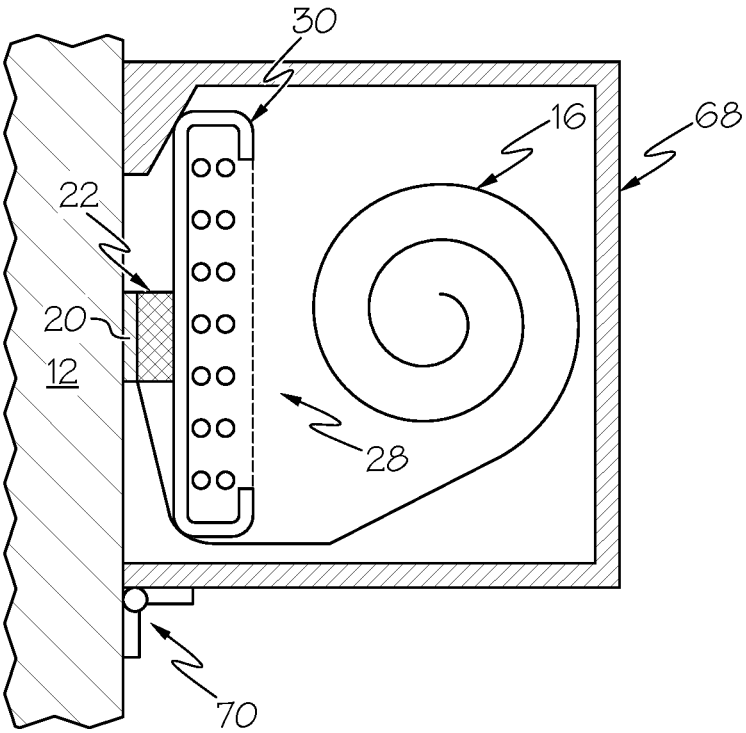
FIG. 9 is an alternative embodiment of a storage system.

Alternatively, a similar storage approach using a one-piece cover 68, as shown in FIG. 9 can be used, with the cover 68 being held by clicking into place behind the top of the drain clip 30. This cover 68 could also include a hinge 70 where it meets the foundation 12 under the bottom of the clip 30, so it will not float away during flood conditions.

While sealing the membrane 16 to the home's foundation 12 is the most preferred installation approach, there may be times where this is not possible. One example is when a driveway or sidewalk that abuts the home completely covers the home's foundation 12. If necessary, the lower edge of the membrane 16 can be routed off the home's foundation 12, onto the adjacent ground—whether soil, concrete or another type of terrain. In these situations, all efforts should be made to give a watertight seal between the membrane 16 and ground, until such a point where the membrane 16 can once again be routed back onto the home's foundation 12. There are various known methods for minimizing water leakage across these areas, depending on the specific details. If the ground is concrete, the first edge 14 can just go from vertical on the foundation 12 to horizontal on the concrete ground, using the standard butyl sealant tape/termination bar sealing approach. If the ground is soil, the edge of the membrane 16 can be buried.

There may also be aesthetic or accessibility reasons where the membrane 16 will need to be routed off the foundation 12. One example is at a front door, if the homeowner doesn't want the membrane 16 visible across the front porch area. In these situations, commercial flood barrier products can be used in combination with the novel protection system 10. For example, a floodproof door panel could be used to avoid having the membrane 16 traverse across the door's threshold (in this case the membrane 16 would terminate at the door frame on either side of the door, in a watertight manner). Or a temporary barrier fence such as the NOAQ Boxwall could be employed, with the membrane 16 being routed off the house 11, onto the Boxwall and then back onto the house 11 after the porch has been bypassed. There are other commercial flood protection products that can be combined with the current system 10, to arrive at a full-home protection system best suited to that particular home 11 and homeowner.

What is claimed is:

1. A flood protection system to protect a building having exterior walls and a foundation from flood water which comprises:

a waterproof membrane positioned on the exterior walls of the building, wherein the membrane has first and second horizontal edges and has a wet side and a dry side;

a sealant between the first horizontal edge of the membrane and the foundation;

a termination bar mechanically attached to the foundation using fasteners, wherein the termination bar presses the first horizontal edge of the membrane and the sealant toward the foundation to create a watertight seal; and a drain system comprising a sheet drain and a sump pump to remove flood water from the dry side of the membrane.

2. The flood protection system of claim 1 wherein the second horizontal edge of the membrane is removably attached to the building at a point above the termination bar.

3. The flood protection system of claim 2 wherein the membrane extends initially downward from the termination bar.

4. The flood protection system of claim 3 wherein the first horizontal edge of the membrane is attached to the foundation at a point above ground level.

5. The flood protection system of claim 4 wherein the membrane comprises ethylene propylene diene terpolymer synthetic rubber.

6. The flood protection system of claim 5 wherein the membrane can be rolled or folded and placed adjacent to the foundation when not in use.

7. The flood protection system of claim 6 further comprising a protection strip attached to the wet side of the membrane just below the termination bar, and having a free edge reversibly attached to the foundation just above the sheet drain to function as a storage system.

8. The flood protection system of claim 7 wherein the membrane has box pleat folds to allow extra room for protrusions and corners on the walls of the building.

9. A flood protection system to protect a building having walls and a foundation from flood water which comprises:

a waterproof membrane positioned on the exterior of the building, wherein the membrane has first and second horizontal edges and has a wet side and a dry side;

a sealant to create a watertight seal between the first horizontal edge of the membrane and the foundation;

a termination bar and fasteners mechanically attaching the first horizontal edge of the membrane and the sealant to the foundation; and a drain system comprising a sheet drain and a sump pump to remove flood water from between the dry side of the membrane and the walls.

10. The flood protection system of claim 9 wherein the membrane comprises ethylene propylene diene terpolymer synthetic rubber.

11. The flood protection system of claim 9 wherein the waterproof sealant is applied to the foundation.

12. The flood protection system of claim 9 wherein the membrane extends initially downward from the termination bar.

13. The flood protection system of claim 9 wherein the second horizontal edge of the membrane is removably attached to the building at a point above the termination bar.

14. The flood protection system of claim 9 wherein the membrane can be rolled or folded and placed adjacent the foundation when not in use.

15. The flood protection system of claim 9 further comprising a protection strip attached to the membrane just below the termination bar, and having a free edge removably attached to the foundation just above the sheet drain to function as a storage system.

16. The flood protection system of claim 9 wherein the second horizontal edge of the membrane is removably attached to the building at a point above the termination bar.

17. The flood protection system of claim 9 wherein the membrane has box pleats folds to allow extra room for protrusions and corners on the walls of the building.

18. A method for flood proofing a building having walls and a foundation comprising:

applying a sealant to the foundation;

pressing a first horizontal edge of a waterproof membrane to the sealant, wherein the membrane has a wet side and a dry side;

attaching a termination bar to the foundation using fasteners that pass through the membrane near the first horizontal edge and through the sealant to form a compressive watertight seal;

attaching a second horizontal edge of the membrane to the walls of the building in a removable manner;

attaching a sheet drain adjacent the foundation of the building; and connecting a sump pump to the sheet drain to collect and remove any flood water from between the dry side of the membrane and the building.

19. The method of claim 18 further comprising folding box pleats in the membrane to allow extra room for protrusions and corners on the walls of the building.

* * * * *